United States Patent [19]

Stevens

[11] Patent Number: 4,484,838

[45] Date of Patent: Nov. 27, 1984

[54] METHOD AND APPARATUS FOR INSTALLING ANODES AT UNDERWATER LOCATIONS ON OFFSHORE PLATFORMS

[75] Inventor: James W. Stevens, Houston, Tex.

[73] Assignee: Shell Oil Company, Houston, Tex.

[21] Appl. No.: 366,804

[22] Filed: Apr. 9, 1982

[51] Int. Cl.[3] ..... B63C 11/00

[52] U.S. Cl. ..... 405/191; 114/312; 405/211

[58] Field of Search ..... 405/169, 185, 188, 190, 405/191, 195, 211; 114/312, 313, 321, 322

[56] References Cited

U.S. PATENT DOCUMENTS

| | | | |
|---|---|---|---|
| 1,320,750 | 11/1919 | Formiglia et al. | 405/191 |
| 3,367,299 | 2/1968 | Sayre | 405/191 X |
| 3,626,703 | 12/1971 | Richburg | 405/191 |
| 3,769,521 | 10/1973 | Caldwell et al. | 405/211 X |
| 4,010,619 | 3/1977 | Hightower et al. | 405/191 |
| 4,041,719 | 8/1977 | Baugh | 405/169 |
| 4,089,767 | 5/1978 | Sabins | 405/211 X |
| 4,252,467 | 2/1981 | Amrhein | 405/188 |

*Primary Examiner*—David H. Corbin

[57] ABSTRACT

Method and apparatus whereby an anode may be mounted on a subsea propulsion vehicle, transported to a selected portion of a platform substructure and then remotely and operatively connected to the substructure, as by explosively-actuated bolts.

22 Claims, 23 Drawing Figures

FIG. 5
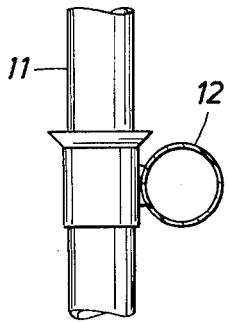
FIG. 6
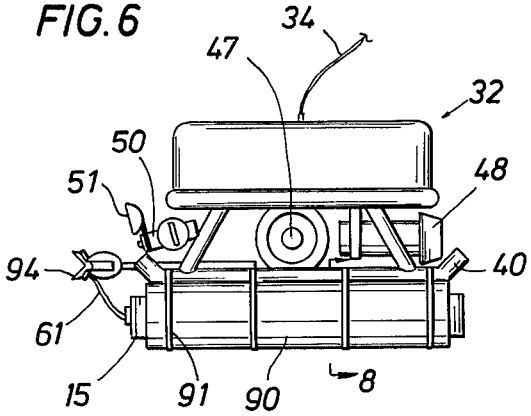
FIG. 7
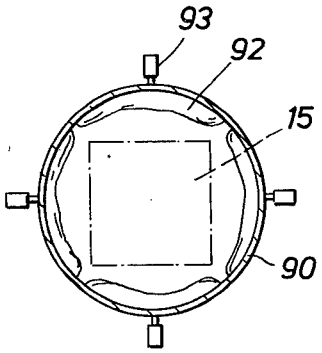
FIG. 8
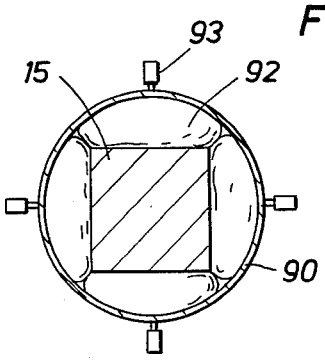
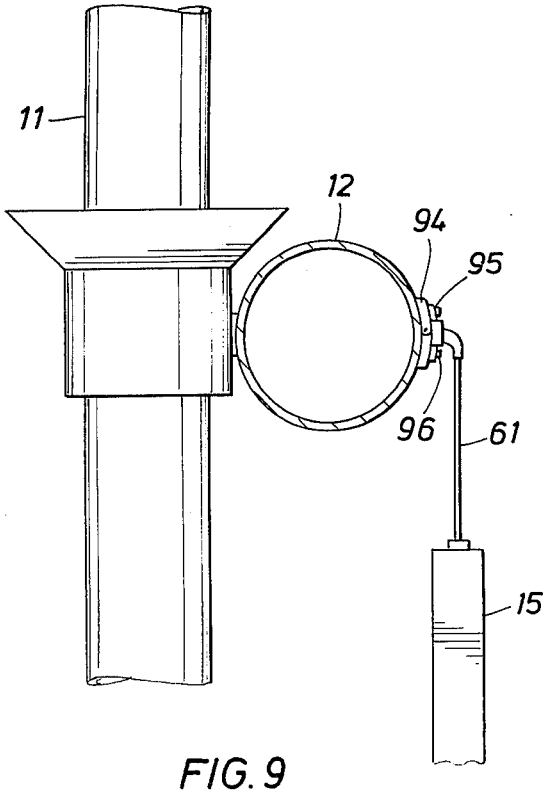
FIG. 9
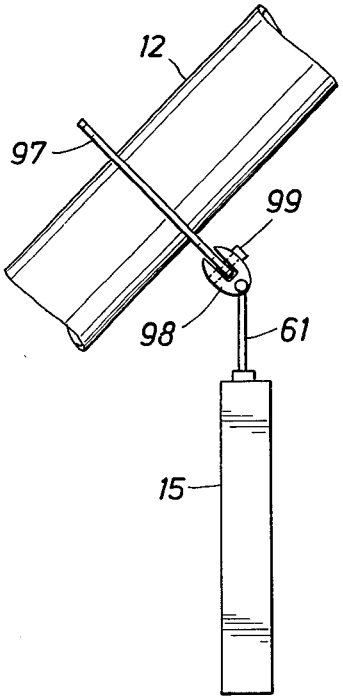
FIG. 10

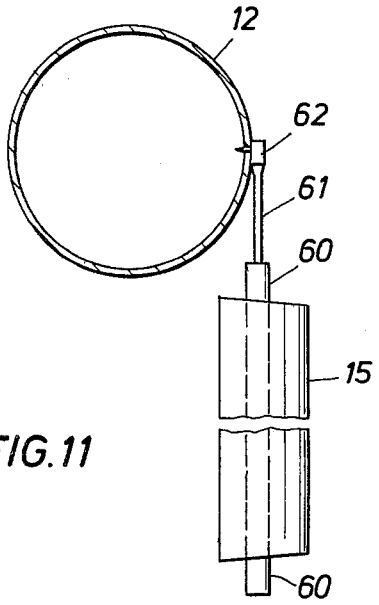
FIG. 11
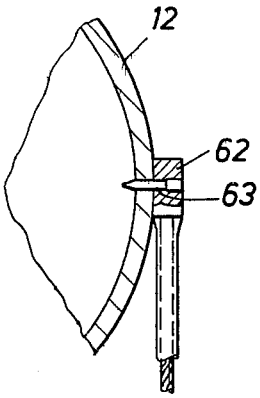
FIG. 12
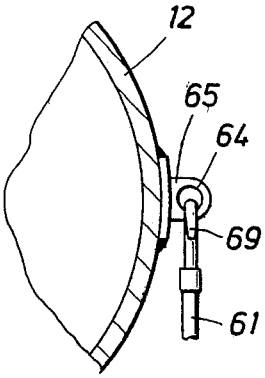
FIG. 13
FIG. 14
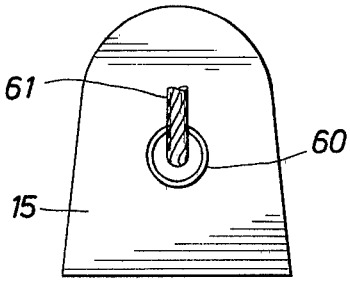
FIG. 15
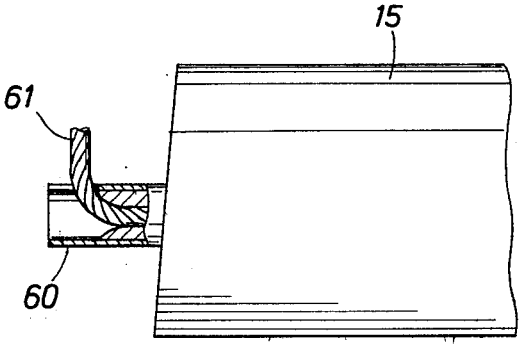
FIG. 17
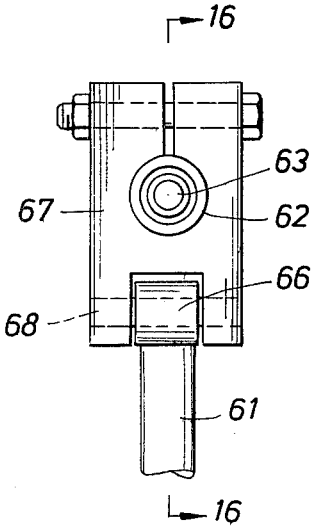
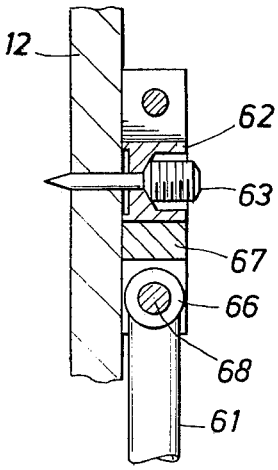
FIG. 16

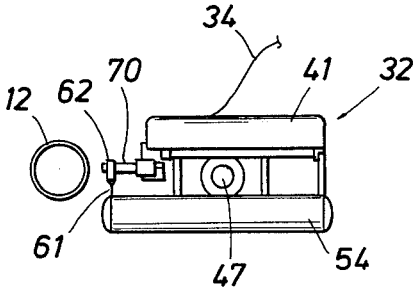
FIG. 18
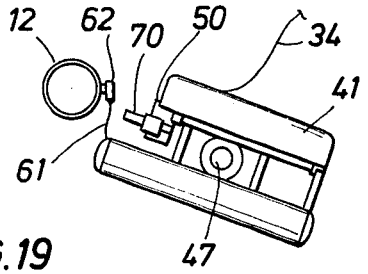
FIG. 19
FIG. 20
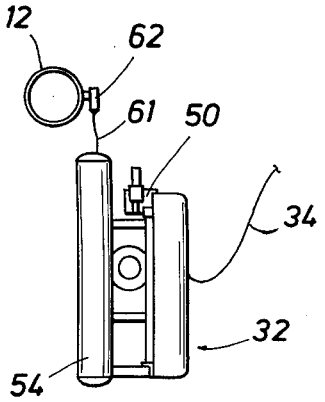
FIG. 21
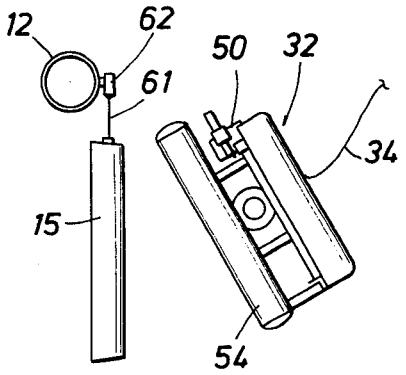
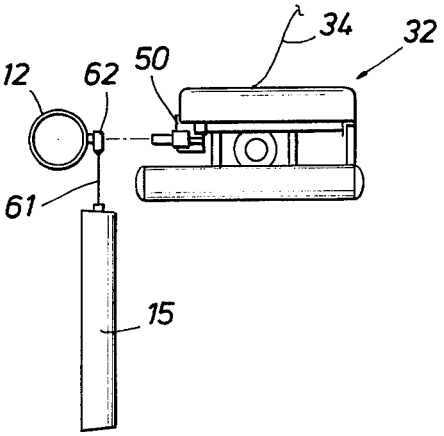
FIG. 22
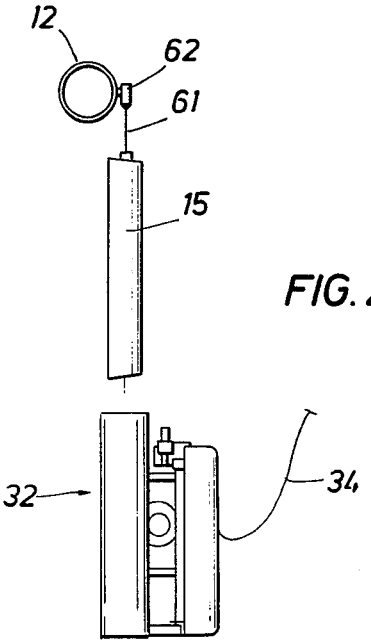
FIG. 23

METHOD AND APPARATUS FOR INSTALLING ANODES AT UNDERWATER LOCATIONS ON OFFSHORE PLATFORMS

BACKGROUND OF THE INVENTION

This invention relates to a method and apparatus whereby an anode may be mounted on a subsea propulsion vehicle, transported to a selected portion of a platform substructure and then remotely and operatively connected to the offshore substructure, as, for example, by explosively-driven fasteners.

Present day offshore platforms used in the oil and gas industry are often formed of large-diameter pipe elements in the form of three or more vertical or slanting legs interconnected or reinforced by cross-bracing tubular members. Such bottom-supported platforms have been used in waters up to 1025 feet deep. The deep water platforms may have more legs which may be tapered. For example, one deepwater platform off the California coast has eight legs that are made of 72 inch diameter pipe at the ocean floor and taper upwardly to 48 inch diameter pipe at sea level. Cross-bracing members are mostly 36 or 42 inches in diameter. In addition, the platform is provided with sixty 24 inch diameter vertical pipes, risers or well conductors which are grouped near the center of the platform and through which individual wells are drilled. Further, the platform supports vertical pipe risers through which oil and gas may be separately pumped down to an ocean floor pipeline and thence to shore.

In order to protect the present offshore platforms from corrosion in sea water, the structural members of the platform are provided with a cathodic protection system which comprises fixedly securing to a plurality of the structural members a number of sacrificial anodes which are preferably made of aluminum, zinc, or an alloy of these and other metals, in a manner well known to the art.

Corrosion in sea water is an electrochemical process. During the chemical reaction of metals with the environment to form corrosion products (such as rust on steel), metallic atoms give up one or more electrons to become positively charged ions and oxygen and water combine with the electrons to form negatively charged ions. The reactions occur at rates which result in no charge build-up. All the electrons given up by metal atoms must be consumed by another reaction.

Cathodic protection is a process which prevents the anodic corrosion reaction by creating an electric field at the surface of the metal so that current flows into the metal. This prevents the formation of metal ions by setting up a potential gradient at the surface which opposes the electric current which arises from the flow of electrically charged ions away from the surface as the product of corrosion. The electric field must be of adequate strength to ensure that metal ions are fully prevented from escaping.

A source of the electric field which opposes the corrosion reaction may be a current supplied from the preferential corrosion of a metal anode with different electrochemical properties in the environment, and which has a stronger anodic reaction with the environment than does the offshore structure. Thus, current flows to the structure from the additional anode, which itself progressively corrodes in preference to the structure. This technique is known as sacrificial anode cathodic protection. This method is used extensively for the protection of offshore platforms, drilling rigs, submarine pipelines, etc.

When a sacrificial system is chosen, the weight of material required to provide the protection current for the protected lifetime of the structure is calculated from a knowledge of the current demand and also the specific electrochemical properties of the anode alloys.

The calculated weight of anode alloy cannot be installed all in one piece but must be distributed over the structure in the form of smaller anodes to ensure uniform distribution of current. In order to select the best size and shape of anode, the total current demand of the structure both at the beginning and end of its life must be considered. The anode must deliver adequate current to polarise the structure and build up cathodic chalks, but also must be capable of delivering the required means current for the structure when 90% consumed.

Thus, on most offshore platforms a multiplicity of anodes are arranged on the various structural members of the platform. These anodes are generally attached to the platform before the platform is lowered to the ocean floor. Generally, the well conductor pipes are not provided with anodes as the conductors are lowered through the deck and driven into the ocean floor after the platform is in position. It has been found that by installing numerous anodes on the structural elements of the platform in the vicinity of the well conductors that the conductors, which are welded at the top to the platform or are in electrical contact with the platform, are adequately protected against electrolytic corrosion in the sea water.

A major problem is encountered with a platform positioned over an offshore oil field with a calculated life of twenty years at the time the field was first put into production. In actuality, the field proved to have a life of forty years or more. Thus, it may be seen that the cathode protection system for the platform is probably inadequate to protect the steel platform from sea water corrosion for this longer period. Hence, it is generally necessary to add additional anodes to the underwater portion of the platform structure. On small simple platforms in shallow water, it is sufficient to lower an anode down through the water on a hoist cable and have a diver connect it to its underwater position on the platform. However, the large deepwater platforms containing a large number of well conductors comprise a maze of vertical and cross-bracing members making it virtually impossible to maneuver some of the anodes into place. Since some of the deepwater platforms may have a lateral dimension of 300 or 400 feet in the lower portion thereof, it may be seen that it would be necessary to move a heavy anode (say, 600 pounds) 200 feet laterally to place it near the center of the platform. One platform to which hundreds of anodes are being added has a base measurement of about 400 feet by 380 feet and is located in 1025 feet of water.

SUMMARY OF THE INVENTION

It is an object of the present invention to provide a method and apparatus for attaching additional anodes of a cathodic-protection system to designated elements of an underwater structure such as an offshore platform used in oil and gas drilling. Use is made of a remotely-controlled underwater vehicle of any suitable type well known to the art. Use is made of a television-equipped self-propelled underwater vehicle equipped with thrusters adapted to be powered and operated, with operations and underwater environment around the vehicle being observed visually at the surface for selectively controlling the operations with the vehicle being connected to the surface location by a power- and signal-transmitting cable.

The underwater vehicle is provided with means for carrying a heavy anode from the surface location down through the body of water to a preselected position within the underwater framework of the platform, and connecting the anode to the platform both mechanically and electrically prior to the vehicle disengaging itself from the anode and returning to the surface location.

An underwater vehicle for connecting an air hose to an underwater hull of a ship is described in U.S. Pat. No. 3,354,658 which issued to S. Leonardi on Nov. 28, 1967. While the Leonardi underwater vehicle is of interest, no provision was made for transporting an object weighing several hundred pounds down to an underwater location and connecting it both mechanically and electrically to a structure at a subsurface location.

It is a further object of this invention to provide a rapid and safe method of adding additional anodes to an underwater structure in deep water using mechanical equipment to remove the associated dangers associated with such an operation when divers are employed.

BRIEF DESCRIPTION OF THE DRAWING

These and other objects and advantages of this invention will become apparent from the description hereinafter following and the drawing forming a part hereof, in which FIG. 5 is a view illustrating one portion of an offshore platform, together with a lateral cross-bracing member, FIG. 6 is a schematic view of another form of a remotely-controlled underwater vehicle approaching the portion of the platform illustrated in FIG. 5, FIG. 7 is a cross-sectional view taken along the line 8—8 of FIG. 6 illustrating the anode carrier with deflated inner diaphragms, FIG. 8 is a view similar to FIG. 7 with the diaphragms expanded against an anode in the anode carrier, FIG. 9 illustrates the platform member of FIG. 5 after a new anode has been secured thereto by the vehicle of FIG. 6, FIG. 10 is a view of another form of a clamp for securing an additional anode to a flange-like appurtenance of the underwater substructure, FIG. 11 is a view showing an anode attached to a pipe member by a different connector means, FIG. 12 is a detailed view taken in partially enlarged section of the connection illustrated in FIG. 11, FIG. 13 illustrates a hook and pad eye type of connection, FIG. 14 is an end view illustrating one form of an anode, FIG. 15 is a partial side view taken in partial cross-section of the anode of FIG. 14, FIG. 16 illustrates another form of a connection between an anode cable and the platform structure, when taken in partial cross-section along the line 16—16 of FIG. 17, FIG. 17 is a sideview of the connector of FIG. 16 illustrating the universal connection, FIGS. 18 thru 22 are schemetic sequential views showing the operation of an underwater vehicle approaching a member of an underwater structure, connecting the anode cable to it, dropping to a vertical position, with the vehicle subsequently releasing itself from the anode and then inspecting the connection in FIG. 22, and FIG. 23 is a schematic view illustrating an underwater vehicle moving downwardly from a newly installed anode to release itself from the anode.

DESCRIPTION OF A PREFERRED EMBODIMENT

Figure 1:
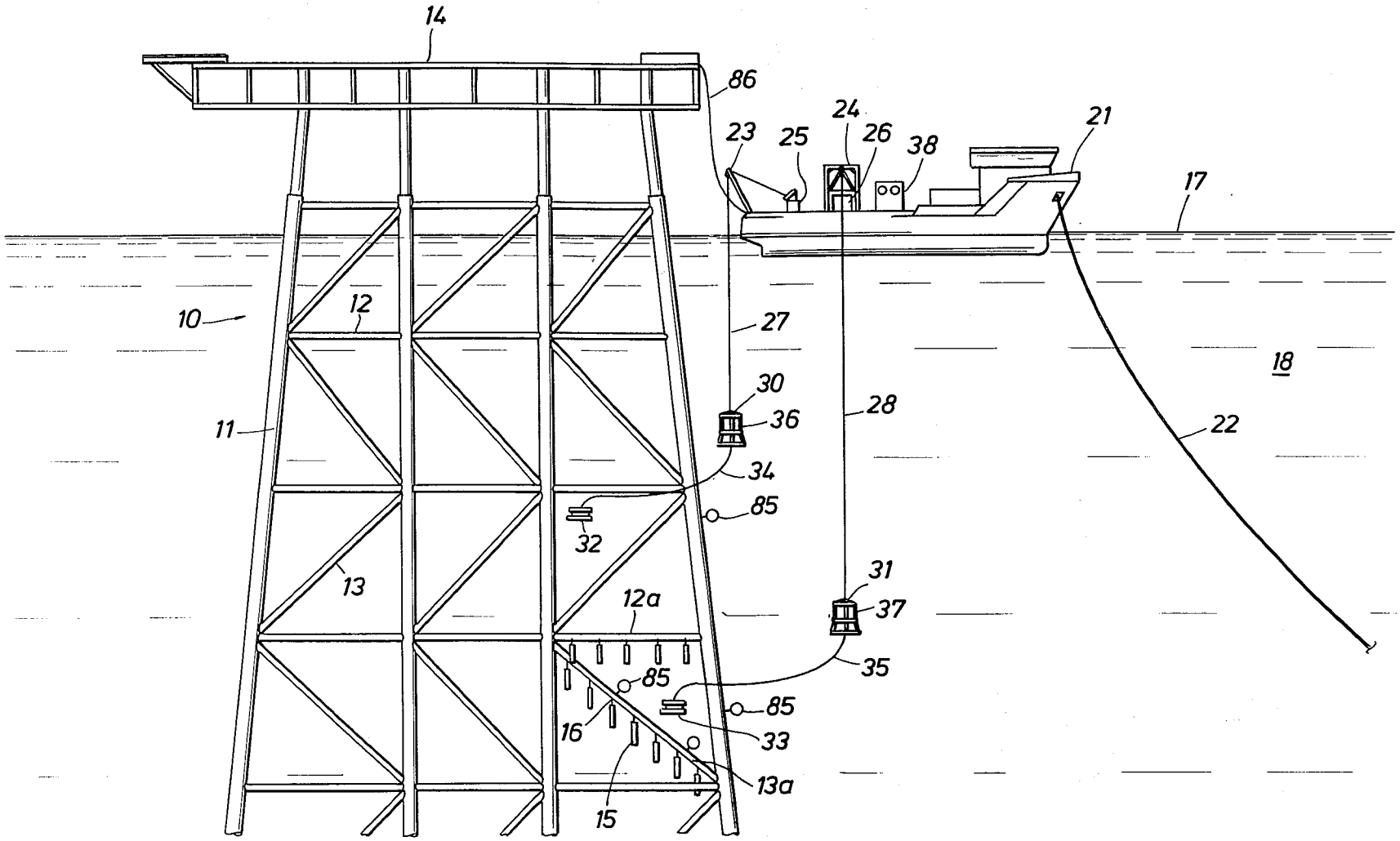
FIG. 1 is a schematic view illustrating the upper portion of an underwater platform alongside which is anchored an operating vessel for lowering a pair of remotely controlled underwater vehicles to a position with the structure.

Referring to FIG. 1 of the drawing, the upper end of an offshore platform 10 is shown as comprising a plurality of substantially vertical legs 11, cross-bracing members 12 and diagonal braces 13. The platform 10 is also provided with a deck 14 but the associated equipment normally carried on a deck is not illustrated. One cross-bracing member **12*a* and one diagonal brace 13*a* are shown as being provided with a plurality of anodes 15 which are shown as being suspended from cables 16. Although the anodes are shown as being suspended from structural members of the platform 10**, they may be secured to these members in any suitable way well known to the art, normally in a fixed manner.

Positioned on the surface 17 of the body of water 18 is a service boat 21 fixedly positioned by one or more anchor lines 22. Next to the platform 10 on which operations are to be carried out, the service boat 21 is provided with a pair of A-frames 23 and 24 having hoist mechanisms or winches 25 and 26 for spooling in or out cables 27 and 28 for raising or lowering protective cages 30 and 31 which may be used to lower remotely-controlled underwater vehicles 32 and 33 down to about the level at which the vehicles 32 and 33 would enter the platform substructure.

The remotely-controlled underwater vehicles 32 and 33 are connected to their respective protective cages 30 and 31 by means of tethers 34 and 35. Remotely-operable reels or drums 36 and 37 are mounted in the upper portions of the cages 30 and 31 and are adapted to be remotely operated through cables 27 and 28 from the service boat 21.

Hoisting cables 27 and 28 are load-supporting cables as well as being equipped to transmit power from the vessel 21 to the vehicles 32 and 33 as well as to pass signals up and down the cables to operate the equipment carried by the vehicles 32 and 33 as well as to operate the tether reels 36 and 37 carried by the cages 30 and 31. In a like manner, the tether cables 34 and 35 are both power- and signal-transmitting cables which preferably are of a neutral buoyancy to reduce the drag on the vehicles 32 and 33 as they move through the water. Power to the vehicles 32 and 33 and signals to and from the vehicles are conducted through cables 27, 28, 34 and 35. Controller means 38 is located on the vessel 21 for controlling the functions of the vehicles 32 and 33 as well as their cages 30 and 31. The controller 38 is also equipped with a television screen for viewing the area in the vicinity of the vehicles 32 and 33.

Remotely-controlled underwater vehicle systems are well known to the art and are manufactured by several companies such as Perry Oceanographics, Inc. of Riviera Beach, Fla., and also Hydro Products of San Diego, Calif. An early design of an underwater vehicle for operation around a submerged oil well installation is described in U.S. Pat. No. 3,099,316 while accessories for such an underwater vehicle are described in U.S. Pat. Nos. 3,163,221, 3,165,899, and 3,463,226.

All of these vehicles are designed to operate from the end of a tether cable and are provided with suitable propulsion means for moving the vehicle in any direction, an operating arm for carrying out an operation under water, and television means connected to a viewing screen at the surface for viewing the operations carried out by the vehicle.

Figure 3:
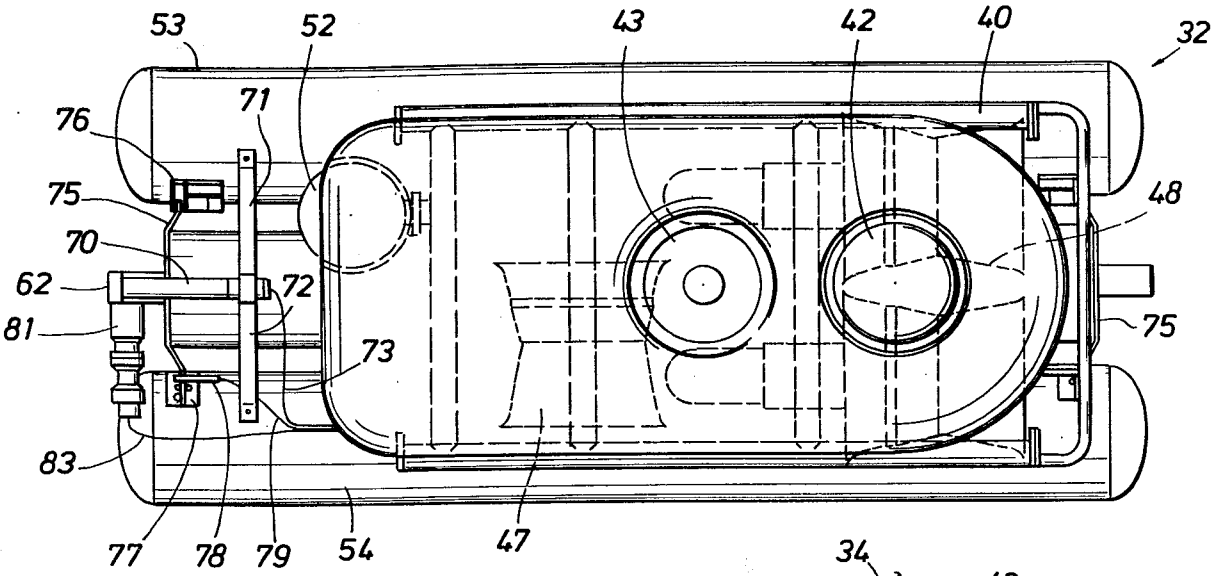
FIG. 3 is a plan view of the underwater vehicle illustrated in FIG. 2.
Figure 2:
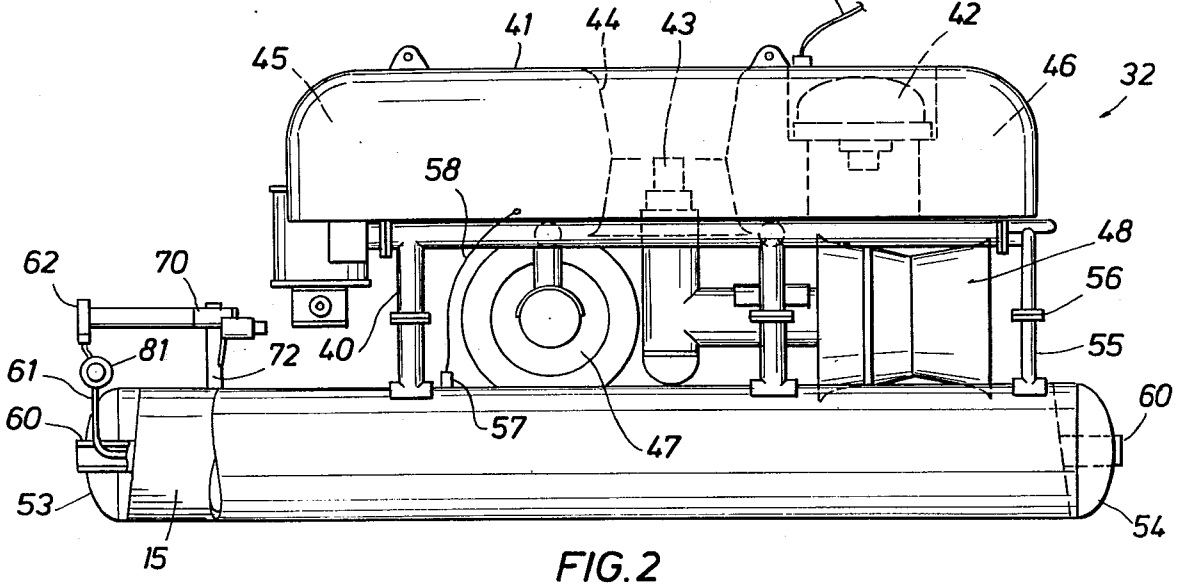
FIG. 2 is a side elevation of a remotely controlled underwater vehicle of a type contemplated in the first invention.
Figure 4:
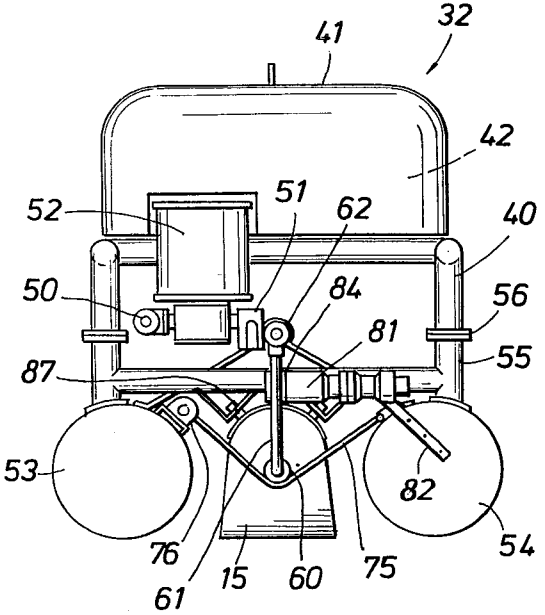
FIG. 4 is an end view of the underwater vehicle shown in FIG. 2.

One form of a remotely-controlled underwater vehicle 32 is shown in greater detail in FIGS. 2, 3, and 4. The vehicle 32 comprises a housing which may be opened or closed or may consist of the combination of both. In FIG. 2, an open framework housing section 40 is surmounted by a closed housing section 41 in which is mounted a control module 42 for receiving signals from an operator at the surface location so as to operate the equipment carried by the vehicle. Preferably centrally positioned and vertically directed on housing 40 is a motor-driven thruster or propulsion unit 43 adapted to discharge vertically in either direction through a conduit 44 extending through the closed housing section 41. The major portion of the closed housing section 41 is filled with a buoyant material, as at 45 and 46, in an amount sufficient preferably to give a slightly positive buoyance to the vehicle 32. It is desired that the vehicle have a slight positive buoyancy so that in the event of loss of power through the tether 34, the vehicle would float to the surface of the body of water. Also carried by the framework portion 40 of the vehicle housing are horizontal thrusters 47 and 48 of any type well known to the art. These thrusters 47 and 48 permit movement of the vehicle horizontally either sideways or fore and aft.

A television unit is carried at one end of the vehicle which will normally be designated as the forward end of the vehicle. The television system comprises a television camera 50 together with one or more suitable lights 51 which are mounted on the housing section 41 with the camera 50 being adapted to be moved in any direction by a pan and tilt mechanism 52 in a manner well known to the art. The television assembly is connected to the control module 42 and thence through cable 34 to the controller 38 on board the vessel 21.

What has been described hereinabove is common to most remotely-controlled underwater vehicles. To this, is added equipment capable of securing an anode 15 to the underwater vehicle and transporting it through the water to an underwater platform structure where it is mechanically and electrically secured to the structure prior to the vehicle releasing itself from the anode.

For this purpose, the vehicle is provided with additional buoyancy which may be in the form of buoyancy tanks 53 and 54 which are secured together in a spaced-apart arrangement by means of a framework 55 which is adapted to be secured by any suitable coupling means 56 to the lower portion of the vehicle 32, in this case, to the lower framework portion 40 of the vehicle. The buoyancy tanks 53 and 54 are provided with suitable remotely-controlled discharge of valves such as the one 57 shown in FIG. 2, which valve may be connected as by means of a cable 58 to the control module 42. Thus, air may be discharged from the buoyancy tanks 53 and 54 after the underwater operation has been completed. The tanks 53 and 54 have sufficient buoyancy to support the framework 55 and associated equipment carried thereby, as well as the anode 15 which may weigh as much as 600 lbs. or more.

For ease in temporarily connecting the anode 15 to the auxiliary frame 55 between buoyancy tanks 53 and 54, the anode 15 is moulded around a 2 inch diameter pipe in a manner such that, say, 4 inches of the pipe 60 extends from each end of the anode. Any suitable design of anode may be employed with the size and design of the anode being governed by the size and payload of the vehicle 32, and the possible interference the anode may have to the thruster flow path in addition to the vehicle's frontal area which affects the drag of the vehicle. The size of the anode being employed with the present invention weighs about 600 lbs. The geometry of the anode 15 is similar to a round-bottomed bread pan with a 2 inch steel pipe running the entire length of the anode and protruding from the ends thereof. Preferably the pipe 60 is sealed at the ends to add buoyancy thereto. The anodes are generally made of aluminum or an alloy of aluminum.

For attaching the anode 15 to an underwater structure, one end of the anode is provided with a flexible steel wire rope or cable 61 which is secured at one end within the pipe 60 extending from the end of the anode. The cable 61 is preferably insulated and protected against corrosion by covering it with a lifetime elastomer, such as, polyurethane.

As shown in greater detail in FIG. 12, the other end of the cable is provided with a collar which may be secured to a suitable cross-brace of the underwater structure by means of a fastener 63. Alternatively, instead of using a collar as illustrated in FIGS. 11 and 12, the other end of the cable 61 may be provided with a hook 69 which is adapted to pass through a hole 64 in a pad eye 65 attached to the cross-brace member 12 of the platform. The pad eye may have been attached to the cross-brace prior to putting the underwater platform at its underwater location or it may be subsequently attached in the same manner that the collar 62 is attached, as will be described hereinbelow. It is essential that the hook and pad eye be of a type that will make an electrical connection between the two elements.

In FIG. 11, an anode is illustrated as having been secured to a cross-brace 12 by means of a pin-anchored collar 62 which is attached to flexible cable 61. A more flexible connection is shown in FIGS. 16 and 17 wherein the cable 61 or a rod substituted therefor may be secured to a bushing 66 which is pivotally secured to a block 67 by means of a pivot pin 68. The block 67, in turn, is pivotally secured to the collar 62 through which an anchoring stud, bolt or pin 63 has been shot by means of an explosively-operated stud gun 70 which is remotely operated from the surface. The stud 63, in being driven through the collar 62 and through the metal wall of the cross-brace member 12 (FIG. 16), electrically connects the anode 15 (FIG. 15) through the cable 61 and collar 62 to the brace member 12. Thus, it may be seen that the clamp arrangement illustrated in FIGS. 16 and 17 forms a universal connector means for securing the cable 61 to the platform element 12.

Referring to FIGS. 2, 3, and 4, the stud gun 70 may be of any suitable commercial type which has been in commercial use for a number of years. The gun 70 is electrically connected through a wire or cable 73 to the control module 42 and thence to the controller 38 aboard the vessel 21 at the surface. The cable-connecting collar 62 is removably carried at the leading end of the stud gun 70 in any suitable manner, as by pressfitting it thereto so that it may be readily disengaged after the stud gun has been energized to explosively drive the pin 63 through the collar 62 and into the platform member, as described with regard to FIGS. 12 through 16. Since a stud may shatter or be deflected when fired from a gun 70 which is more than 7° from a perpendicular line to the surface in which the stud is being seated and to which the collar 62 is being attached, it is preferred that a gun 70 be employed that has a safety override on it that prevents the gun from firing when it is more than, say, 5° off the normal. Alternatively, a sensor on the gun may be used that indicates to the operator at the surface at the controller 38 what the gun angle is prior to firing.

Any suitable type of anode carrier may be employed to carry the anode 15 beneath the vehicle 32. For example, grab-type clamp arms illustrated in U.S. Pat. No. 3,163,221 may be mounted on the auxiliary frame 55 for holding the anode 15. Preferably, however, a simple lightweight anode carrier is provided in the form of a pair of cables 75, one of which is illustrated in FIG. 4 as being arranged to stretch between the buoyancy tanks 53 and 54 and pass under the pipe 60 around which the anode 15 is molded. It will be understood that another cable identical to cable 75 is arranged at the other end of the anode and stretches between the buoyancy tanks 53 and 54. One end of the cable 75 is secured to a buoyancy tank 53 by means of an electrically or hydraulically-actuated release mechanism 76. This release mechanism 76 is operatively connected to the control module 42 and thence to the surface controller 38 where the operator has control of its operation. Preferably, controls would be employed so that the release mechanism 76 could not be actuated if the gun 70 had not been fired so as to securely anchor the anode 15 to the structure. For a rapid handling of anodes at the surface when mounting them on the vehicle 32, the other end of the cable 75 is preferably secured to a line tensioner 77. Between the line tensioner and the anode 15, an emergency cable cutter 78 is mounted on the buoyancy tank 54 and for control is connected by wire 79 to the control module 42. (FIG. 3) Thus, in the event that the cable release mechanism 76 fails to work after an anode had been connected to the underwater structure, the emergency cable cutter 78 may be energized from the surface to accomplish the same purpose. The carrier cable may be made of a plastic rope material of sufficient strength to support the 600 lb. or more anode 15.

A second cable cutter 81 is mounted on the front end of the vehicle, as by means of a strap 82 secured to the buoyancy tank 54. As shown in FIG. 3 the cable cutter 81 is connected via wire 83 to the control module 42. While from a view of FIG. 2 the cable 61 extending from the anode 15 appears to pass upwardly through the cable cutter 81 and thence to the collar 62 carried at the end of stud gun 70, it will be seen from viewing FIG. 4 that the front side of the cable cutter 81 is provided with an open slot 84 whereby, after successfuly attaching the anode to the underwater platform by means of stud gun 70, the anode 15 can be released from the vehicle 32 with the anode cable 61 pulling out of the slot 84 in its original condition. The cable cutter 81 would only be used in the event that a poor mechanical or electrical connection was made by the stud gun 70 in driving the pin 63 (FIG. 16) through the collar 62 and into the platform element 12. If a poor electrical connection was made, the anode would be inoperative. Thus, to recover the anode 15 and have the vehicle 32 take it back to the surface vessel 21, the anode 15 could be disconnected from its improperly anchored collar 62 by shearing the cable 61.

FIGS. 18 through 23 illustrate various steps in utilizing the apparatus of the present invention for carrying out the method of attaching a cathodic protection system anode to an underwater platform structure by means of a television-equipped self-propelled underwater vehicle having thrusters adapted to be powered and operated from a surface vessel so that the operations in the underwater environment around the vehicle may be observed visually at the surface plus electrically controlling the operations from a surface location which is connected to the vehicle by means of a power- and signal-transmitting cable. It is to be understood that when the vehicle 32 is aboard the vessel 21, an anode 15 (FIGS. 14 and 15) is secured to the bottom of the vehicle in a manner illustrated in FIGS. 2, 3, and 4, that is, by means of carrier cables 75. The vehicle 32 is then lowered into the water and the buoyancy thereof is adjusted to a substantial neutral or slightly positive buoyancy. The vehicle may then be propelled by means of its thrusters 43, 47, and 48 (FIG. 2) down through the water and into the underwater structure where an anode is to be fixedly secured to the structure.

It has been found to be time saving to have a vehicle make a preliminary trip down to its destination without having the heavy anode attached thereto. In this preliminary survey trip, the best possible path of movement for the vehicle through the structure could be determined and underwater television-visible markers or strobe lights may be secured to the underwater structure along the path that the vehicle is to take when installing the anode. These markers 85 are illustrated in FIG. 1. Preferably, as illustrated in FIG. 1, the vehicle, after having its buoyancy adjusted at the surface, is secured to its carrier cage 36 with the tether 34 in a retracted position on the drum 36 within the cage 30. The cage 30 is them lowered on its cable 27 to about the depth at which the operation is to be carried out. After seeing the marker 85 on the platform, the vehicle 32 would enter the platform and follow the previous set markers to its destination. Upon arriving at its destination, as illustrated in FIG. 18, the vehicle 32 would approach the structural member 12. The operator on board the vessel at the controller 38 operates the thrusters 43, 47, and 48. (FIG. 3) to move the vehicle 32 (FIG. 18) forward against the pipe section 12 so that the anode cable 61 connector means 62 carried at the end of the stud gun 70, is forced tightly against the pipe 12 in a manner such that the stud gun 70 is substantially perpendicular to the axis of the pipe 12.

The operator on the surface vessel 21 then energizes the stud gun 70 so as to drive the stud or pin 63 into the connector collar 62 and thence into the wall of the pipe 12 in a manner sufficient to anchor firmly the anode collar 62 to the pipe 12 so that the anode may be supported therefrom, as shown in FIGS. 11, 12, and 16. FIG. 19 illustrates the operation just after the thruster 48 (FIG. 3) has been reversed so as to pull the stud gun 70 away from the connector 62. At this time, the television camera on the vehicle 32 is employed by the operator at the controller 38 on the vessel to look at the stud 63 with respect to the surrounding collar 62 (FIG. 16) to determine whether the stud 63 has been fully set in the collar 62 in order to give a good mechanical connection to the pipe member 12. In general, an adequately set stud will also provide an electrical connection between the anode 15, its cable 61, and collar 62 with the pipe member 12 that the pin 63 penetrates. Prior to disconnecting the vehicle 32 from the anode 15, it may be desirable at this point to make a resistance measurement between the anode 15 and the structure 12 by utilizing one of the conductors in the cable 27 and tether 34. The circuit would run from the tether 34 to the anode 15 and through its cable 61 to the pipe 12 (FIG. 19) and thence up through a platform leg 11 (FIG. 1) to the deck of the platform which, in turn, would be electrically connected through cable 86 to the controller 38. The operator would read the total electrical loop resistance to determine continuity of the circuit. An incorrectly set connector pin 63 would give an infinite resistance reading indicating that the pin was not electrically connecting the anode to the platform. It is understood that other methods may be used to determine an adequate electrical contact between the pin 63 and the structure member 12. Thus, a measurement could be taken of the current flowing in the member 12 which connects to the anode. A device used to make this measurement may be carried on the vehicle 32 and electrically connected to the surface through its tether, and to the structure through cable 86.

After the anode connection has been checked, the vehicle's auxiliary buoyancy tanks 53 and 54 are flooded by remotely opening the valves 57 (FIG. 3). When the position of the vehicle in water is substantially that shown in FIG. 20, the vehicle 32 is disconnected and move sideways to a position shown in FIG. 21. To accomplish this operation the operator at the surface vessel 21 actuates the hydraulic or electric release device 76 (FIG. 4) which disconnects the cables 75 carried at both ends of the anode 15 to be suspended against the lower framework 55. If desired, the lower frame 55 may be provided with a plurality of shock mounts 87 which bear against the top of the anode 15 and are in compression when the anode 15 is pulled up by cable 75 into its carrying position, as shown in FIG. 4. Thus, on release of the cables 75, the shock mounts 87 push the anode 15 away from the lower frame 55. At the same time the operator at the surface controls the vehicle thruster 43 (FIG. 3) so as to move the vehicle 32 away from the anode 15 as shown in FIG. 21. The vehicle 32 is then raised to a horizontal position as shown in FIG. 22 whereby the connection made by the connecting collar amd its associated pin 63 can be checked visually by means of the television camera 50 carried by the vehicle. The vehicle is then returned to its cage 30 (FIG. 1) and hoisted with the cage to the surface where another anode may be loaded into place on the bottom of the vehicle.

Another form of a remotely-controlled underwater vehicle is illustrated in FIG. 6 with the upper portion comprising the housing, thrusters, television and lights being substantially identical to that shown and described with regard to FIGS. 2, 3, and 4. The vehicle of FIG. 6 however is provided with an anode carrier 90 secured to the frame 40 of the vehicle in any suitable manner as by means of straps 91. As shown in FIGS. 7 and 8, the anode carrier 90 is of a diameter greater than the width of the anode 15 whereby the anode 15 can be carried within the anode carrier 90. Surrounding the inner wall of the anode carrier 90 are a plurality of expansible, flexible air bags 92 with remotely controlled valves being provided for introducing air to the bags or allowing it to escape therefrom. The bags are of a size in volume sufficient to act as the buoyancy means for supporting the weight of the anode while it is being carried by the vehicle. Frictional contact between the bags and the anode is generally sufficient to prevent the anode from slipping out of the carrier while being transported by the vehicle.

The operation of employing the vehicle of FIG. 6 to secure an anode 15 to the pipe member 12 of FIG. 5, the operation is similar to that described hereinabove with regard to the vehicle of FIG. 2. The collar or connector 94 of FIG. 6 may be carried by dual stud gun whereby a pair of studs 95 and 96 (FIG. 9) may be driven into the pipe 12 to secure the connector 94 and allow the anode 15 to hang therefrom. In the event that the structural member 12 of the platform is provided with a stiffener plate 97, as shown in FIG. 10, a U-shaped connector 98 having an explosively driven riveter stud 99 may be employed to hang the anode 15 from the stiffener plate 97.

As illustrated in FIG. 23, the main difference in operations when the vehicle of FIG. 6 is employed is that after connecting the anode 15 to the pipe 12, the operator on the surface vessel 21 actuates the remotely controlled valves 93 (FIG. 8) to allow the air bags 92 (FIG. 8) to assume their deflated position as shown in FIG. 7. With the anode carrier bags 92 deflated, the operator reverses one of the thrusters on the vehicle 32 and the vehicle is propelled downwardly off of the anode 15, as shown in FIG. 23. It is essential to reduce the buoyancy of the anode carrier of either type of underwater vehicle as otherwise, with the weight of the anode removed, the decreased weight of the vehicle relative to its buoyancy would cause it to rise swiftly through the water and be damaged when it hit any of the platform structure. Also, the tether 34 of the vehicle would become entangled with the various structural members of the platform.

I claim as my invention:

1. Method of attaching a cathodic-protection system anode provided with connector means to an underwater structure with a television-equipped self-propelled underwater vehicle equipped with thrusters adapted to be powered and operated with operations and underwater environment being observed visually at the surface for selectively controlling the operations from a surface location connected to the vehicle by a power- and signal-transmitting cable, said method comprising:

above the surface of a body of water, attaching an anode to be carried to the self-propelled underwater vehicle in a disconnectible manner at a point below the center of gravity of said vehicle, adjusting the vehicle and the connected anode to at least neutral buoyancy, lowering the vehicle and anode through the water together and propelling the vehicle and anode to a position adjacent a selected member of the underwater structure to which the anode is to be transferred from the vehicle to the underwater structure, connecting the anode to the selected point on the underwater structure, decreasing the buoyancy of the vehicle to a value sufficient to maintain the vehicle alone at just above neutral buoyancy, disconnecting the vehicle from the anode now connected to the underwater structure, propelling the vehicle from the underwater position adjacent the structure to the surface of the body of water.

2. The method of claim 1 including the step of observing the results of connecting the anode to the underwater structure and determining that an adequate weight-supporting connection has been made.

3. The method of claim 2 including the step of determining that the connected anode is electrically connected to the underwater structure in a manner sufficient to pass a current.

4. The method of claim 1 including, after adjusting the buoyancy of the vehicle and the anode, installing the vehicle and anode in a disconnectible manner to a cable-supported lowering housing, lowering the housing, vehicle and anode to a selected water depth adjacent the underwater structure, disconnecting the vehicle and anode from the lowering housing, and propelling the vehicle and anode to a selected position where the anode is to be connected to the underwater structure.

5. The method of claim 1 wherein the connector means carried by the vehicle and secured to the anode for connecting the anode to the underwater structure includes remotely-actuatable explosively-set pin means, said method including the steps of positioning the pin means of the anode connector means against the point on the underwater structure at which the connection is to be made, operating the vehicle thrusters in a direction and with a force sufficient to maintain the connector means firmly against the structure, and energizing the anode connector means to explosively drive the pin means into the underwater structure at the selected point.

6. The method of claim 1 including the steps of providing the anode connector means with remotely-actuatable explosively-set pin means, positioning the pin means of the anode connector means against the point on the underwater structure at which the connection is to be made, observing the positioning of the pin means at the connection point, and energizing the anode connector means from the surface to explosively drive the pin means into the underwater structure at the selected point to mechanically and electrically connect the anode to the underwater structure.

7. The method of claim 1 wherein, prior to propelling the vehicle and anode through the body of water, a anode-connection point on a selected member of the underwater structure is marked in a manner that can be seen by television means carried by the vehicle and at a point which can be contacted by the anode-connection means.

8. The method of claim 7 wherein, prior to propelling the vehicle and anode through the body of water to the anode-connection point, a plurality of underwater television-visible markers are secured to a plurality of structural members of the underwater structure along a line of flight for the vehicle to follow from the periphery of the underwater structure an anode-connection point.

9. The method of claim 8 including the step of spacing the underwater television-visible markers one from another at distances not greater than the visible range of the television-equipped vehicle.

10. Method of attaching an object of negative buoyancy provided with connector means to an underwater structure with a self-propelled underwater vehicle adapted to be powered and operated with operations and underwater environment being observed at the surface for selectively controlling the operations from a surface location, said method comprising above the surface of a body of water, attaching an object of negative buoyancy to be supported to the self-propelled underwater vehicle in a disconnectible manner at a point below the center of gravity of said vehicle, totally supporting the object of negative buoyancy on the vehicle by adjusting the vehicle and its object of negative buoyancy to at least neutral buoyancy so they can move through the water freely while attached, lowering the vehicle and its object through the water together and propelling the vehicle and object to a selected member of the underwater structure at which the object is to be transferred from the vehicle to the underwater structure, connecting the supported object to the selected point on the underwater structure, decreasing the buoyancy of the vehicle to a value sufficient to maintain the vehicle alone at just above neutral buoyancy, disconnecting the vehicle from the object now connected to the underwater structure, and moving the vehicle from the underwater position adjacent the structure to the surface of the body of water.

11. Apparatus adapted to be secured to a self-propelled underwater vehicle operating at the end of a power- and signal-transmission cable extending in a body of water from the surface thereof, said apparatus having buoyancy means, propulsion means, and means for viewing at least the water area forward of the vehicle and operations carried out by the vehicle at an underwater structure in that area, said apparatus comprising:

auxiliary support means, means for connecting the support means to and beneath a self-propelled underwater vehicle, carrier means centrally and longitudinally mounted on said support means below substantially the center of gravity thereof for carrying an object in a total-weight supported manner to an underwater location and subsequently releasing it from a surface location, auxiliary variable-buoyancy means carried by said support means of a size to contain sufficient air to buoyantly support the frame support means and the object to be carried thereby to an underwater structure, remotely-actuatable air-discharge valve means carried by said auxiliary buoyancy means and in operative communication therewith for discharging air therefrom, and remotely operable means carried by said support means for releasing the carrier means from said object.

12. The apparatus of claim 11 wherein the auxiliary buoyancy means comprises at least two spaced-apart buoyancy tanks fixedly secured to said auxiliary support means along a front-to-back direction beneath the auxiliary support means of said underwater vehicle, the spacing between the tanks being greater than the width of an anode to be positioned therein.

13. The apparatus of claim 11 wherein the auxiliary buoyancy means comprises a hollow, elongated carrier chamber housing fixedly secured to said auxiliary support means along a front-to-back direction beneath the auxiliary support means, at least the front end of said chamber housing being open, said open end having a width greater than the width of an anode to be positioned in the chamber housing, air bag means secured to said chamber housing, said air bag means being of a volume to support the chamber housing and an anode adapted to be carried therein, and selectively- and remotely-actuatable valve means on said air bag means for allowing air to discharge from said air bag means.

14. The apparatus of claim 12 including selectively- and remotely-actuatable valve means on each of the buoyancy tanks for allowing air to discharge from each of said tanks.

15. The apparatus of claim 12 wherein the carrier means mounted on said support means comprises at least a pair of spaced-apart support straps anchored to said support means for supporting an anode between the spaced-apart buoyancy tanks, anchoring means at the ends of each strap for anchoring it to said support means, and a remotely-actuatable quick-release device carried by at least one of the anchoring means at one end of each strap.

16. The apparatus of claim 15 wherein said support straps are made of a plastic material.

17. The apparatus of claim 15 including remotely-actuatable strap cutter means carried by said support means for each of said straps, said strap cutter means engaging the straps in a normally non-operative mode.

18. The apparatus of claim 11 wherein the means carried on said support means for connecting said anode carried thereby to an underwater structure comprises a remotely-actuatable explosively-operated stud gun carried on the forward end of said support means above the auxiliary buoyancy means, a pin in said gun adapted to be driven therefrom and partially through a cable connector on an anode to be secured to the underwater structure.

19. The apparatus of claim 18 including an elongated anode positioned in said carrier means of said support means, a flexible connector cable attached to the forward end of said anode, pin-anchorable connector collar affixed to the other end of said anode connector cable, said collar having a hole therethrough of a size to receive said pin from said stud gun, said collar being adapted to be carried at the forward end of said stud gun.

20. The apparatus of claim 19 including remotely-actuatable cable-cutting means carried by said support means, said cable-cutting means being positioned to engage operatively the anode support cable in a loaded state.

21. The apparatus of claim 16 including separator means fixedly secured to the support means within the carrier means, said separator means being arranged to extend substantially downwardly to bear against the top of an anode in the carrier means, so as to urge the anode therefrom upon release of the anode support straps.

22. An underwater vehicle adapted to be operated from a remote location above the surface of a body of water through a power- and signal-transmitting tether cable, said vehicle being adapted to connect to an anode, carry it to an underwater structure, connect it to the structure and release from the anode, said vehicle comprising housing means, power-actuated thruster means carried by said housing means for propelling said housing means in any direction, television means carried by said housing means for viewing illuminated water area near the housing means, light means carried by said housing means for illuminating the area adjacent said television means, buoyancy means carried by said housing means for maintaining said housing means and equipment carried thereby at a buoyancy of no less than neutral buoyancy, auxiliary support means connected to the housing means below the center of gravity thereof, anode carrier means formed by said support means for releasably securing an anode thereto, auxiliary buoyancy means secured to said auxiliary support means of a capacity sufficient to support an anode, anode connector mechanism carried by said auxiliary support means for securing an anode to an underwater structure, means on said auxiliary buoyancy means for reducing the buoyancy applied to said anode an amount sufficient to counteract the weight of the anode, and means for releasing said anode carrier means from an anode.

* * * * *